US007641947B2

(12) United States Patent
Chen et al.

(10) Patent No.: US 7,641,947 B2
(45) Date of Patent: Jan. 5, 2010

(54) STACKABLE INKJET RECORDING MATERIAL

(75) Inventors: Tienteh Chen, San Diego, CA (US); Douglas E. Knight, San Diego, CA (US); Tao Chen, San Diego, CA (US); Eric L. Burch, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 615 days.

(21) Appl. No.: 11/441,536

(22) Filed: May 26, 2006

(65) Prior Publication Data

US 2007/0275190 A1 Nov. 29, 2007

(51) Int. Cl.
*B41M 5/00* (2006.01)

(52) U.S. Cl. ..... 428/32.22; 428/32.26; 428/206; 428/220; 428/325; 428/341

(58) Field of Classification Search ..... 428/32.22, 428/32.26, 206, 220, 325, 341
See application file for complete search history.

(56) References Cited

U.S. PATENT DOCUMENTS

| | | | | |
|---|---|---|---|---|
| 5,277,965 | A | 1/1994 | Malhotra | |
| 6,436,514 | B1 * | 8/2002 | Ishiyama et al. | 428/32.22 |
| 6,638,585 | B2 | 10/2003 | Niu et al. | |
| 2002/0022116 | A1 * | 2/2002 | Iu et al. | 428/195 |
| 2002/0022117 | A1 * | 2/2002 | Kitamura et al. | 428/195 |
| 2002/0182380 | A1 * | 12/2002 | Nagashima et al. | 428/195 |
| 2004/0067345 | A1 | 4/2004 | Hladik et al. | |
| 2005/0025915 | A1 | 2/2005 | Uhlir-Tsang et al. | |
| 2005/0142306 | A1 | 6/2005 | Uhlir-Tsang et al. | |
| 2006/0045997 | A1 | 3/2006 | Hladik | |

FOREIGN PATENT DOCUMENTS

| | | | |
|---|---|---|---|
| EP | 0524635 | A1 | 1/1993 |
| EP | 0602494 | A1 | 6/1994 |
| EP | 1262329 | A2 | 12/2002 |

* cited by examiner

*Primary Examiner*—Betelhem Shewareged

(57) ABSTRACT

In one aspect of the present system and method, an inkjet recording medium includes a photobase layer, a layer of inorganic oxide dispensed on a first side of the photobase layer, and a layer of ink vehicle absorbing layer formed on a second side of the photobase layer.

35 Claims, 4 Drawing Sheets

STACKABLE INKJET RECORDING MATERIAL

BACKGROUND

Inkjet printing has become a popular way of recording images on various media surfaces, particularly paper, for a number of reasons, including, low printer noise, capability of high-speed recording, and multi-color recording. Additionally, these advantages of inkjet printing can be obtained at a relatively low price to consumers. Though there has been great improvement in inkjet printing, improvements are followed by increased demands from consumers for higher speeds, higher resolution, full color image formation, increased stability, etc.

In recent years, as digital cameras and other digital image collecting devices have advanced, image recording technology has attempted to keep pace by improving inkjet image recording on paper sheets and the like. The desired quality level of the inkjet recorded images ("hard copy") is that of traditional silver halide photography. In other words, consumers would like inkjet recorded images that have the color reproduction, image density, gloss, etc. that is as close to those of silver halide photography as possible.

Traditional recording sheets for the inkjet printing process are not adequate to provide silver halide quality images. Particularly, there is a need to improve ink absorptiveness, ink absorption rate, image quality, water fastness and light stability.

SUMMARY

In one aspect of the present system and method, an inkjet recording medium includes a porous ink receiving layer having an ink absorbing polymer coated on a rear side thereof.

In another exemplary embodiment, a method for forming an inkjet recording medium includes providing a photobase layer, dispensing a porous ink receiving layer on a first side of the photobase layer, and forming a layer of ink absorbing polymer on a second side of the photobase layer.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
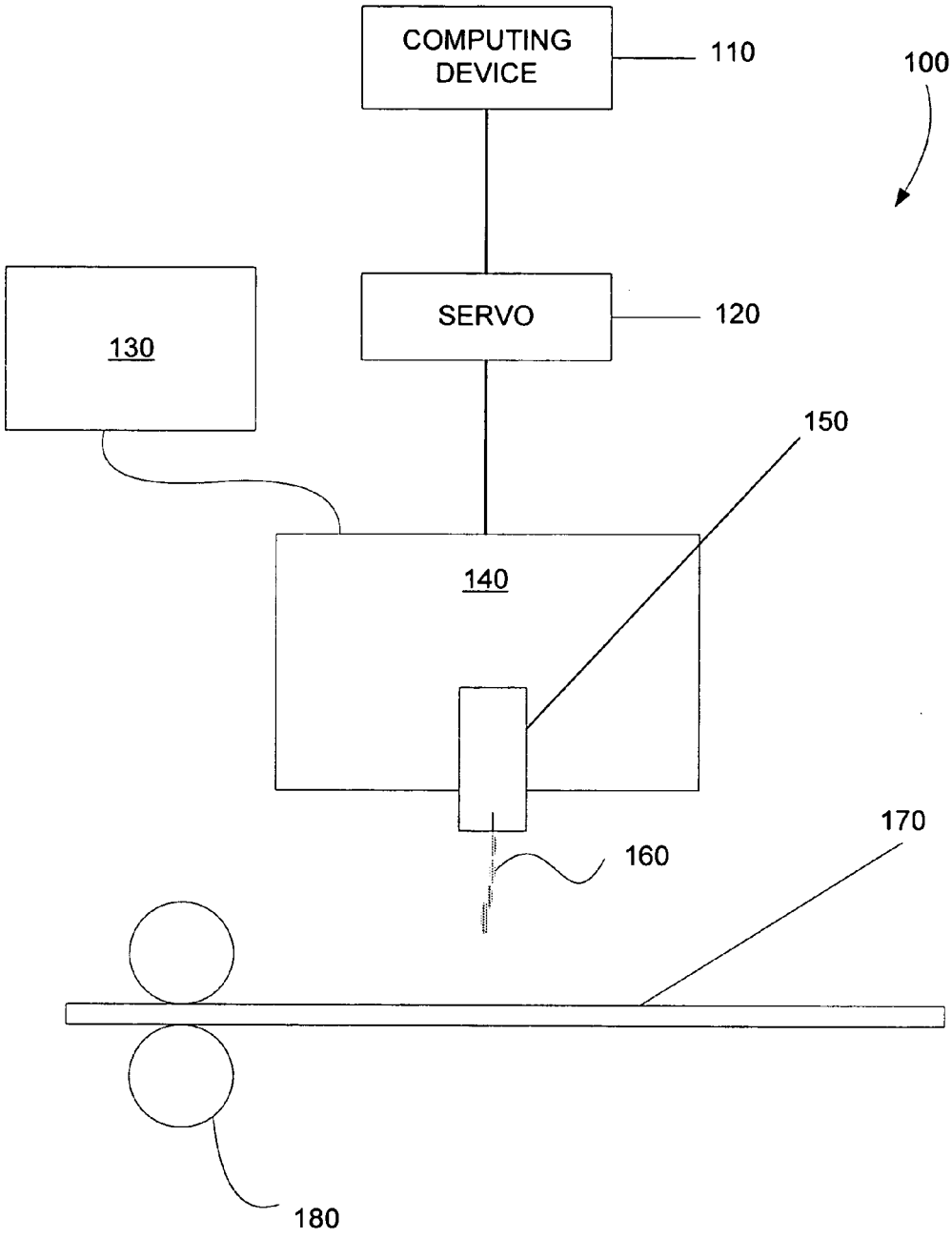
FIG. 1 is a simple block diagram illustrating an inkjet material dispensing system, according to one exemplary embodiment.

The present specification discloses an exemplary porous ink recording material having improved stacking performance. According to one exemplary embodiment disclosed herein, the porous ink recording material includes a porous inkjet ink receiving material coated on a first side of a photobase layer and an ink absorbing polymer coated on a second side of the photobase layer. Incorporation of the ink absorbing polymer on the second side of the photobase layer prevents curling, haze, bleed, and colorshifting. Further details of the present ink recording material will be provided below.

Before particular embodiments of the present system and method are disclosed and described, it is to be understood that the present system and method are not limited to the particular process and materials disclosed herein as such may vary to some degree. It is also to be understood that the terminology used herein is used for the purpose of describing particular embodiments only and is not intended to be limiting, as the scope of the present system and method will be defined only by the appended claims and equivalents thereof.

As used in the present specification and in the appended claims, the term "liquid vehicle" is defined to include liquid compositions that can be used to carry colorants, including pigments, to a substrate. Liquid vehicles are well known in the art, and a wide variety of liquid vehicle components may be used in accordance with embodiments of the present exemplary system and method. Such liquid vehicles may include a mixture of a variety of different agents, including without limitation, surfactants, co-solvents, buffers, biocides, viscosity modifiers, sequestering agents, stabilizing agents, and water. Though not liquid per se, the liquid vehicle can also carry other solids, such as polymers, UV curable materials, plasticizers, salts, etc.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

Additionally, as used herein, the term "curling" shall be understood to refer to any distortion of a sheet of paper or other inkjet recording medium due to differences in coating from one side to another or due to absorption of moisture.

Further, the term "bleed" shall be understood both here and in the appended claims as referring to any unwanted migration of ink after printing onto a desired substrate. Similarly, the term "colorshifting" is meant to be understood as a change in the coloration of a printed image due to bleed or other ink migration.

Further, the term "stacking haze" shall be understood both here and in the appended claims as referring to any reduction in the black optical density of a printed image as measured by the densitometry. Stacking haze is cause by the absorption of ink vehicles in the porous inkjet medium.

In the following description, for purposes of explanation, numerous specific details are set forth in order to provide a thorough understanding of the present system and method for producing an exemplary porous ink recording material having improved stacking performance. It will be apparent, however, to one skilled in the art, that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

FIG. 1 illustrates an exemplary system (100) that may be used to apply an inkjet ink (160) onto an inkjet recording medium (170), according to one exemplary embodiment. As shown in FIG. 1, the present system includes a computing device (110) controllably coupled through a servo mechanism (120) to a moveable carriage (140) having an inkjet dispenser (150) disposed thereon. A material reservoir (130) is coupled to the moveable carriage (140), and consequently to the inkjet print head (150). A number of rollers (180) are located adjacent to the inkjet dispenser (150) configured to selectively position the inkjet recording medium (170). The above-mentioned components of the present exemplary system (100) will now be described in further detail below.

The computing device (110) that is controllably coupled to the servo mechanism (120), as shown in FIG. 1, controls the selective deposition of an inkjet ink (160) onto the inkjet recording medium (170). A representation of a desired image or text may be formed using a program hosted by the computing device (110). That representation may then be converted into servo instructions that are then housed in a processor readable medium (not shown). When accessed by the computing device (110), the instructions housed in the processor readable medium may be used to control the servo mechanisms (120) as well as the movable carriage (140) and inkjet dispenser (150). The computing device (110) illustrated in FIG. 1 may be, but is in no way limited to, a workstation, a personal computer, a laptop, a digital camera, a personal digital assistant (PDA), or any other processor containing device.

The moveable carriage (140) of the present printing system (100) illustrated in FIG. 1 is a moveable material dispenser that may include any number of inkjet material dispensers (150) configured to dispense the inkjet ink (160). The moveable carriage (140) may be controlled by a computing device (110) and may be controllably moved by, for example, a shaft system, a belt system, a chain system, etc. making up the servo mechanism (120). As the moveable carriage (140) operates, the computing device (110) may inform a user of operating conditions as well as provide the user with a user interface.

As an image or text is printed on the inkjet recording medium (170), the computing device (110) may controllably position the moveable carriage (140) and direct one or more of the inkjet dispensers (150) to selectively dispense an inkjet ink at predetermined locations on the inkjet recording medium (170) as digitally addressed drops, thereby forming the desired image or text. The inkjet material dispensers (150) used by the present printing system (100) may be any type of inkjet dispenser configured to perform the present method including, but in no way limited to, thermally actuated inkjet dispensers, mechanically actuated inkjet dispensers, electrostatically actuated inkjet dispensers, magnetically actuated dispensers, piezoelectrically actuated dispensers, continuous inkjet dispensers, etc. Additionally, the present inkjet recording medium (170) may receive inks from non-inkjet sources such as, but in no way limited to, screen printing, stamping, pressing, gravure printing, and the like.

The material reservoir (130) that is fluidly coupled to the inkjet material dispenser (150) houses and supplies an inkjet ink (160) to the inkjet material dispenser. The material reservoir may be any container configured to hermetically seal the dye based inkjet ink (160) prior to printing.

FIG. 1 also illustrates the components of the present system that facilitate reception of the inkjet ink (160) onto the inkjet recording medium (170). As shown in FIG. 1, a number of positioning rollers (180) may transport and/or positionally secure an inkjet recording medium (170) during a printing operation. Alternatively, any number of belts, rollers, substrates, or other transport devices may be used to transport and/or postionally secure the inkjet recording medium (170) during a printing operation, as is well known in the art.

Figure 2:
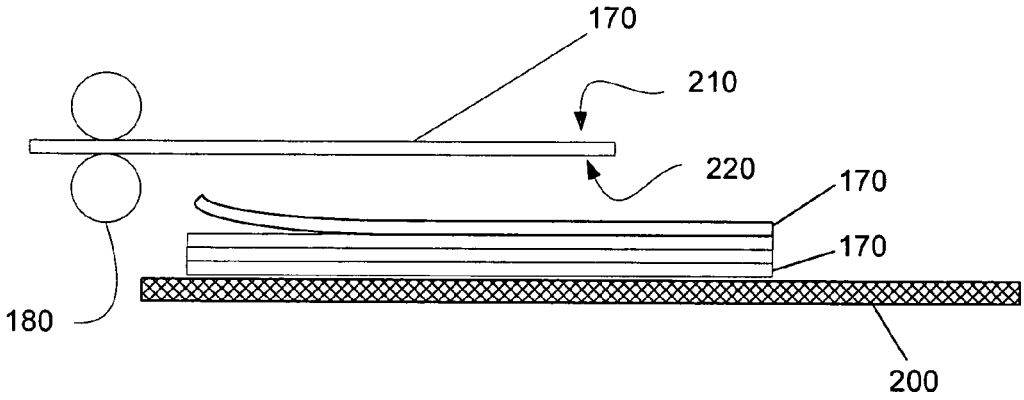
FIG. 2 is a side cross-sectional view illustrating a plurality of photobase paper sheets stacked after printing, according to one exemplary embodiment.

As illustrated in FIG. 2, when the desired image is formed on the inkjet recording medium (170), the inkjet recording medium is transferred away from the printing system (100) and onto an output tray (200). As a plurality of images are printed onto the ink recording mediums (170), they are stacked on the output tray (200) with bottom surfaces (220) of subsequently printed ink recording mediums contacting top image reception surfaces (210) of previously printed substrates. While this traditional stacking method saves space and provides for the easy assembly of multi-page documents, traditional photobase paper may experience bleeding and colorshifting due to the contact at the interface between the bottom surface (220) and top image reception surface (210) of consecutively printed substrates before the ink vehicles completely evaporate from the ink recording medium.

Specifically, traditional high image quality photobase substrates are co-extruded with polyethylene or polypropylene to provide high gloss and a photo feel. However, stacking of the coated porous inkjet recording medium right after image printing often results in color bleed, color shifting, and hazing due to the high amount of ink vehicles including solvents used in dye based inkjet inks.

In contrast to traditional recording materials, the present systems and methods provide a porous inkjet recording medium (170) that serves as a high gloss photobase substrate while exhibiting improved stacking performance. Further details of the composition and formation of the exemplary inkjet recording medium will now be described in detail below with reference to FIGS. 3 through 4.

Exemplary Composition

Figure 3:
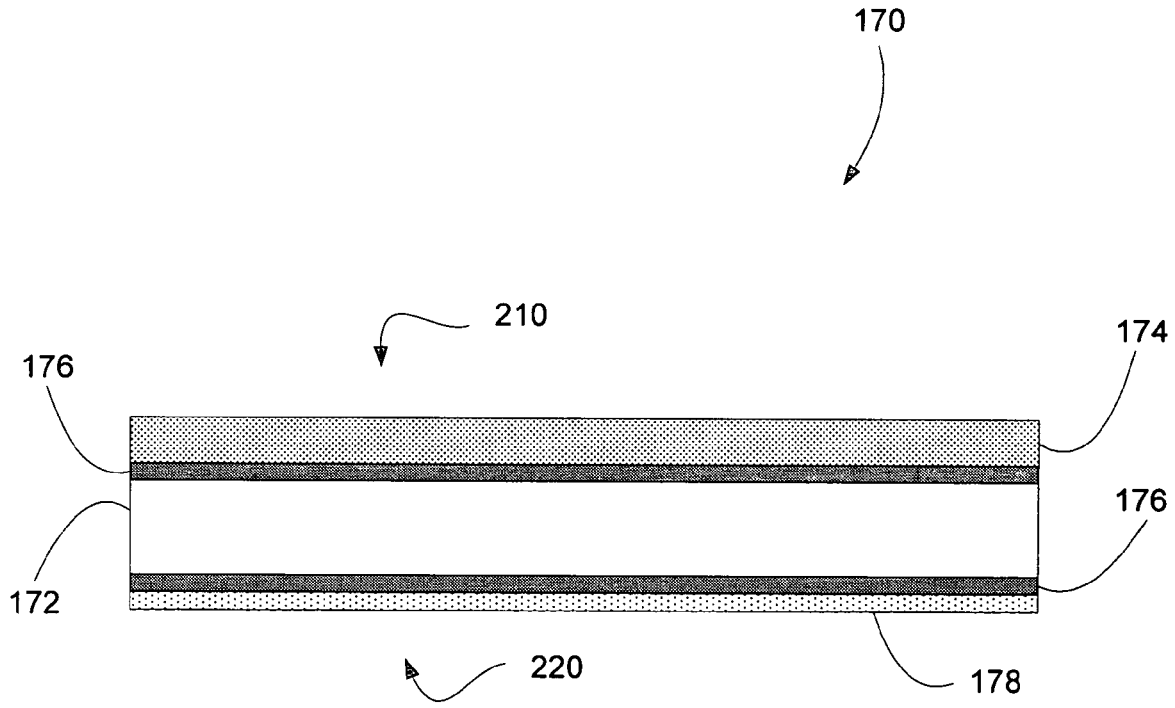
FIG. 3 is a side cross-sectional view illustrating the layers of a porous inkjet recording substrate having an ink absorbing polymer back layer, according to one exemplary embodiment.

One exemplary composition of the present exemplary inkjet recording medium exhibiting improved stacking performance (170) is illustrated in FIG. 3. As shown in FIG. 3, the present exemplary inkjet recording medium (170) includes a photobase layer (172), a barrier layer (176) formed on each side of the photobase layer, a porous ink-absorbing layer (174) formed on the top image reception surface (210) of the photobase layer, and an ink vehicle absorbing layer layer (178) formed on the bottom surface (220) of the photobase layer. As a result of the illustrated configuration, the disclosed inkjet recording medium (170) improves the traditionally poor stacking performance of photobase paper while providing a high-gloss ink recording medium. The individual components of the present inkjet recording medium exhibiting improved stacking performance (170) will be described in further detail below.

Photobase Layer

The present exemplary inkjet recording medium (170) is formed on a substrate (172) or support. According to one exemplary embodiment, any number of traditionally used paper fiber substrates may be used to form the substrate (172) of the present exemplary inkjet recording medium (170). More specifically, according to one exemplary embodiment, any number of raw base paper supports may be employed in the practice of the present system and method. Examples include, but are not limited to, any un-extruded paper that consists of fibers, fillers, additives, etc., used to form an image supporting medium. More specifically, the substrate (172) in the form of a raw base paper core may be made of any number of fiber types including, but in no way limited to, virgin hardwood fibers, virgin softwood fibers, recycled wood fibers, and the like.

Additionally, fibers used to form the present raw base paper core substrate (172) may be less than approximately 3.0 mm in weighted average length. More specifically, according to one exemplary embodiment, the fibers used to form the raw base paper core substrate (172) may range in weighted average length from between approximately 0.5 mm to approximately 3.0 mm upon completion of a fiber refining process.

In addition to the above-mentioned fibers, the present raw base paper core substrate (172) may include, but is in no way limited to, a number of filler and additive materials. According to one exemplary embodiment, the filler materials include, but are in no way limited to, clay, kaolin, calcium carbonate ($CaCO_3$), gypsum (hydrated calcium sulfate), titanium oxide, and/or cellulose fiber.

More specifically, according to one exemplary embodiment, up to 40% by dry weight of the raw base paper core substrate (172) may be made up of fillers including, but in no way limited to, calcium carbonate ($CaCO_3$), Clay, kaolin, gypsum (hydrated calcium sulfate), titanium oxide ($TiO_2$), talc, Alumina trihydrate, magnesium oxide (MgO), minerals, and/or synthetic and natural fillers. Inclusion of the above-mentioned fillers, according to one exemplary embodiment, reduces the overall cost of the raw base paper core substrate (172) in a number of ways. The inclusion of white filler such as calcium carbonate may enhance the brightness, whiteness, and the quality of the resulting image supporting medium.

Additionally, additives that may be added include, but are in no way limited to, sizing agents such as metal salts of fatty acids and/or fatty acids, alkyl ketene dimer emulsification products and/or epoxidized higher fatty acid amides; alkenyl or alkylsuccinic acid anhydride emulsification products and rosin derivatives; dry strengthening agents such as anionic, cationic or amphoteric polyacrylamides, polyvinyl alcohol, cationized starch and vegetable galactomannan; wet strengthening agents such as polyaminepolyamide epichlorohydrin resin; fixers such as water-soluble aluminum salts, aluminum chloride, and aluminum sulfate; pH adjustors such as sodium hydroxide, sodium carbonate and sulfuric acid; optical brightening agents; and coloring agents such as pigments, coloring dyes, and fluorescent brighteners.

In addition to the above-mentioned filler and additive materials, less than 20% of the raw base paper core substrate (172) may be fine content having a particle size of 0.2-5 microns, according to one embodiment, including chopped or fragmented small woody fiber pieces formed during the refining process of the pulp. According to one exemplary embodiment, the fine content may range from between 4 to 10% by dry weight. A reduction in fine content facilitates the management of wet-end operation and retention. Additionally, the raw base paper layer may include any number of retention aids, drainage aids, wet strength additives, de-foamers, biocides, dyes, and/or other wet-end additives.

Barrier Layer

As mentioned previously, the substrate (172) may also be coated on at least a top image reception surface with a barrier layer (176) formed by an extrudable resin coating. According to one exemplary embodiment illustrated in FIG. 3, both the top image reception surface (210) and the bottom surface (220) of the substrate (172) are co-extruded with a barrier layer (176) including, but in no way limited to, polyethylene, polyvinylbutyral, or polypropylene. The inclusion of a barrier layer (176) on the substrate (172) provides both high gloss and a photo feel to the present exemplary inkjet recording medium (170).

Figure 4:
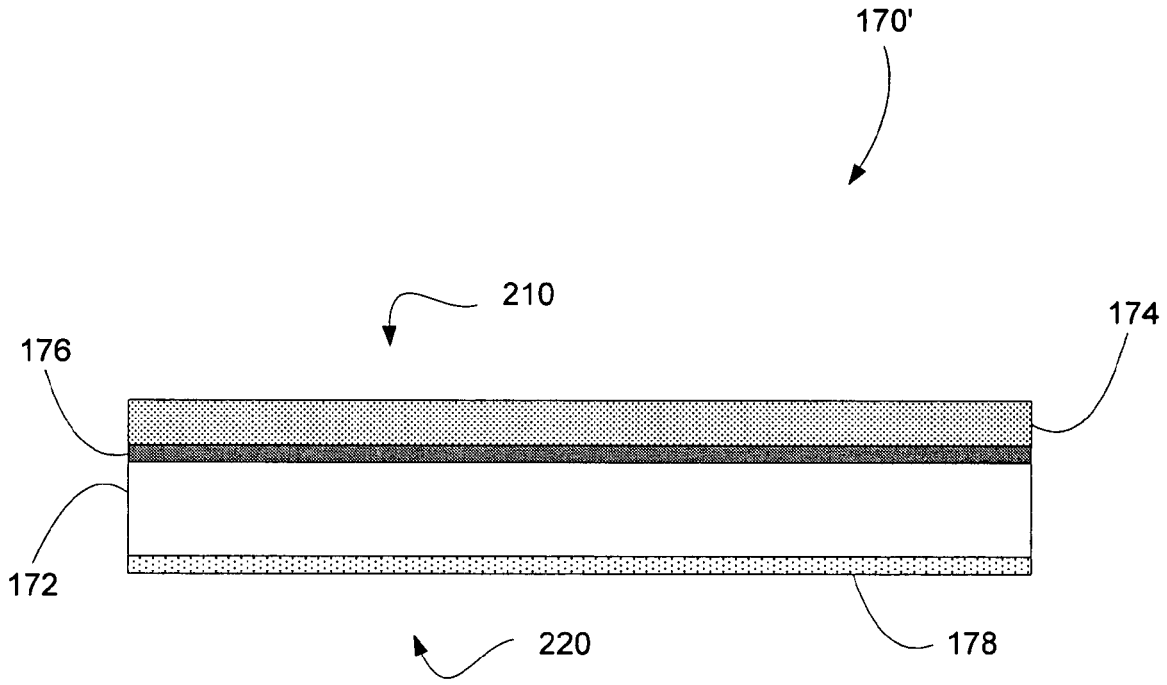
FIG. 4 is a side cross-sectional view illustrating the layers of a porous inkjet recording substrate having an ink absorbing polymer back layer, according to one exemplary embodiment.

In one alternative embodiment, illustrated in FIG. 4, only the top image reception surface (210) of the alternative exemplary inkjet recording medium (170') includes an extruded barrier layer (176) including, but in no way limited to, polyethylene or polypropylene. The inclusion of the single extruded barrier layer provides a high gloss and photo feel on the top image reception surface (210). Regardless of the number of barrier layers (176) included in the exemplary inkjet recording medium (170), the top layer of the top image reception surface (210) includes a porous ink-absorbing layer (174).

Porous Ink-Absorbing Layer

As illustrated in FIG. 3, the top layer of the top image reception surface (210) includes a porous ink-absorbing layer (174). According to one exemplary embodiment, the porous ink-absorbing layer (174) formed on the top image reception surface (210) includes but is in no way limited to approximately 20-40 GSM of high porosity inorganic oxide dispersion plus a binder and other additives. The present porous ink-absorbing layer (174) has a high ink absorbing capacity resulting in a near instantaneous drying of deposited ink.

Specifically, according to one exemplary embodiment, the high porosity inorganic oxide dispersion includes any number of inorganic oxide groups including, but in no way limited to, a fumed silica or alumina, treated with silane coupling agents containing functional groups. The dry coatweight of the first layer of fumed silica or alumina treated with silane coupling agents containing functional groups that form the porous ink-absorbing layer (174) may vary from approximately 20 to 50 GSM but preferably from 25 to 35 GSM. According to one exemplary embodiment, the lower alumina-containing or fumed silica containing basecoat serves to attract the solvent(s) comprising the inkjet ink vehicle, thereby aiding in relatively rapid drying of an ink printed thereon. According to one exemplary embodiment, the fumed silica may be selected from the following group of commercially available fumed silica: Cab-O-Sil LM-150, Cab-O-Sil M-5, Cab-O-Sil MS-55, Cab-O-Sil MS-75D, Cab-O-Sil H-5, Cab-O-Sil HS-5, Cab-O-Sil EH-5.

According to one exemplary embodiment, the substrate (172) is coated with fumed silica. The fumed silica may be treated with the aluminum chlorohydrate (ACH) or silane coupling agents containing amino functional groups and then disposed on the photobase layer (172). According to this exemplary embodiment, the fumed silica may be any silica in colloidal form. Specifically, according to one exemplary embodiment, the aggregate size of the fumed silica is between approximately 50 to 300 nm in size. More specifically, the fumed silica is preferred between approximately 100 to 250 nm in size. The Brunauer-Emmett-Teller (BET) surface area of the fumed silica is between approximately 100 to 400 square meters per gram. More specifically, the fumed silica is preferred to have a BET surface area of 150 to 300 square meters per gram. Accordingly, the zeta potential, or the electrokinetic measurement used to control the stability of a colloid, of the organic treated silica at a pH of 3.5 is at least 20 mV.

Alternatively, the substrate (172) may be coated with an alumina that is similarly treated with the silane coupling agents containing functional groups. According to one exemplary embodiment, the alumina coating comprises pseudo-boehmite, which is aluminum oxide/hydroxide ($Al_2O_3.n\,H_2O$ where n is from 1 to 1.5). Additionally, according to one exemplary embodiment, the photobase layer (174) is coated with an alumina that comprises rare earth-modified boehmite, containing from about 0.04 to 4.2 mole percent of at least one rare earth metal having an atomic number from 57 to 71 of the Periodic Table of Elements. According to this exemplary embodiment, the rare earth elements are selected from the group consisting of lanthanum, ytterbium, cerium, neodymium, praseodymium, and mixtures thereof. The presence of the rare earth changes the pseudo-boehmite structure to the boehmite structure. The presence of the rare earth element provides superior lightfastness, compared with an alumina basecoat not including the rare earth element. The preparation of the pseudo-boehmite layer modified with rare earths is more fully described in U.S. Pat. No. 6,156,419, the contents of which are incorporated herein by reference.

As mentioned above, the layer of fumed silica or alumina can be treated with silane coupling agents containing functional groups, ACH, or combinations thereof. According to one exemplary embodiment, the silane coupling agents contain functional groups such as primary amine, secondary amine, tertiary amine, quaternary amine, etc. According to one exemplary embodiment, the silane coupling agent with the amine functional group is used to convert the anionic silica to a cationic silica that is configure dot fix an anionic dye that is dispensed thereon.

As mentioned, the present porous ink-absorbing layer (174) may also include any number of surfactants, buffers, plasticizers, and other additives that are well known in the art.

During application, the present porous ink-absorbing layer (174) can be coated onto the substrate (172) by any number of material dispensing machines and/or methods including, but in no way limited to, a slot coater, a curtain coater, a cascade coater, a blade coater, a rod coater, a gravure coater, a Mylar rod coater, a wired coater, and the like.

Ink Vehicle Absorbing Layer

As illustrated in FIGS. 3 and 4, an ink vehicle absorbing layer (178) is formed on the bottom surface (220) of the photobase layer (172). According to one exemplary embodiment, the ink vehicle absorbing layer (178) may be any number of polymers configured to absorb ink solvents, such as water, alcohol, pyrrolidone, and other high boiling water miscible solvents. Specifically, the polymers forming the ink vehicle absorbing layer (178) may include, but are in no way limited to, polyvinylalcohol, derivatized polyvinylalcohol such as polyvinylalcohol containing carboxylic, amino, quaternary ammonium, alkoxysilanes, and acetoacetylated functional groups, polyethylene-co-polyvinylalcohol, polyvinylalcohol-co-poly(vinylamine), homo and copolymer of polyvinylpyrolidone, polyvinylpyrolidone-co-polyvinylalcohol, hydroxyethylcellulose, hydroxypropylcellulose, homo and copolymer of 2-methyl-oxazoline and 2-ethyl-oxazoline, poly(hydroxyethylmethacrylate), poly(hydroxyethylacrylate), homo and copolymer of poly(acrylamide) and poly(methacrylamide), homo and copolymer of poly(vinylamide), water dispersible polyesters, water dispersible polyurethane, polymer latex, PEO, PPO, PEO-PPO copolymer, Ethylene-Co-Acrylic Acid (EAA), and blends thereof. According to one exemplary embodiment, polyethylene-co-polyvinylalcohol is chosen. According to this exemplary embodiment, the mole percent of ethylene is from 0 to 50% and more specifically from 5 to 25%. The weight average molecular weight, according to this exemplary embodiment, is from 1000 to 1,000,000. Examples of commercially available polyethylene-co-polyvinylalcohol that may be suitable for this application includes, but is in no way limited to: EVAL M (24 mole % ethylene content), EVAL L (27 mole % ethylene content), EVAL F (32 mole % ethylene content), EVAL C (35 mole % ethylene content), EVAL H (38 mole % ethylene content), EVAL E (44 mole % ethylene content), AND EVAL G (48 mole % ethylene content) manufactured by Eval Americas (Houston, Tex.).

According to one exemplary embodiment, the ink vehicle absorbing layer (178) may be coated or co-extruded onto the bottom surface (220) of the substrate (172) by any number of extrusion coating methods. Particularly, according to one exemplary embodiment, the ink vehicle absorbing layer (178) may be deposited on the photobase layer by any extrusion coating method including, but in no way limited to, a slot coater, a curtain coater, a cascade coater, a blade coater, a rod coater, a gravure coater, a Mylar rod coater, a wired coater, and the like.

Further, according to one exemplary embodiment, the absorptive capabilities of the ink vehicle absorbing layer (178) may be enhanced by forming a relatively rough surface finish on the exposed surface of the layer. According to one exemplary embodiment, the phrase "relatively rough surface finish" shall be interpreted as any coating surface having a surface roughness of at least approximately 200 Sheffield units. A relatively rough surface finish will enhance the capillary action of the ink vehicle absorbing layer (178) and increase the absorptive nature of the coating. The relatively rough surface finish may be formed on the exposed surface of the ink vehicle absorbing layer (178) by any number of methods including, but in no way limited to, embossing the ink vehicle absorbing layer or compressing a newly formed ink vehicle absorbing layer on a roller having a desired mating finish.

According to this exemplary embodiment, the inclusion of the ink vehicle absorbing layer (178) on the back side of the substrate (172) results in improved stacking qualities and curl resistance. More particularly, according to one exemplary embodiment, when a plurality of the present exemplary ink recording mediums (170) receive printed images on the top image reception surface (210) and are subsequently stacked, as illustrated in FIG. 2, the ink vehicle absorbing layer (178) on the bottom surface (220) of the substrate (172) absorbs any ink solvent or other ink component that has not been fully dried in the adjacent porous ink-absorbing layer (174). Consequently, haze, bleed, and color shifting of images on stacked media is greatly reduced. Additionally, the ink vehicle absorbing layer (174) reduces the curling tendencies of the porous ink recording medium. Specifically, the modulus of elasticity provided by the ink vehicle absorbing layer (174) provides resistance to bending or curling of the inkjet recording medium (170) due to ink absorption.

According to one exemplary embodiment of the present system and method, the polymers were tested for water solubility. Specifically, the water solubility was performed by placing the polymers in water for 24 hours at 25° C. After the polymers had soaked in water for 24 hours, the un-dissolved solids were filtered and dried. Once dried, the change in weight from the un-dissolved solids compared to the original weight was used to determine water solubility. As tested, the ink vehicle absorbing layer of the present system and method includes polymers having water solubility greater than 1% at 25° C.

Additionally, according to one exemplary embodiment of the present exemplary system and method, the ink vehicle absorbing layer was tested for water absorption. Specifically, the film or polymer was dipped in water for approximately 24 hours at 25° C. The film or polymer was then wiped of excess water and the weight gain of the polymer was evaluated for water absorption. According to one exemplary embodiment, the ink vehicle absorbing layer of the present exemplary system and method exhibited polymers configured to absorb greater than 1.0% by weight water when soaked for 24 hours at approximately 25° C.

EXAMPLES

The following examples illustrates the embodiments of the system and method that are presently best known. However, it is to be understood that the following is only exemplary or illustrative of the application of the principles of the present system and method. Numerous modifications and alternative compositions, methods, and systems may be devised by those skilled in the art without departing from the spirit and scope of the present system and method. The appended claims are intended to cover such modifications and arrangements. Thus, while the present system and method has been described above with particularity, the following examples provide further detail in connection with what is presently deemed to be the most practical and preferred embodiments of the present system and method.

Example 1

In the present example, a number of substrates were coated on a back side with various ink vehicle absorbing layers, according to the systems and methods illustrated above. A standard test image was printed on a photo-based porous inkjet recording medium with a HP Deskjet 6500 printer.

Immediately after the image was ejected from the printer, test substrate coated with various ink vehicles absorbing polymers was placed on the surface of test image so that the ink vehicles absorbing polymer layer was contacted with the test image. 20 sheets of plain paper were placed on the top of the stacked image. After test image was stacked for 24 hours, the amount of ink lost during stacking, as well as the haze and color shift were then evaluated. Haze was measured by the change in L*min and colorshift was measured by Delta E.

TABLE 1

| Exp. No. | Barrier Layer on First Side | Barrier Layer on Second Side | Coat-weight (GSM) | Ink lost % after stacking | Haze Delta L | Average Gray shift DE | Average Green shift DE | Max Bleeding mil | Remark |
|---|---|---|---|---|---|---|---|---|---|
| 1 | PE | PE | 40 | 29.00% | 4.9 | 3.5 | 7.9 | 20 | Control |
| 2 | PE | Poval CP7000 | 12 | 54.27% | 2.5 | 1.6 | 4.5 | 6 | Invention |
| 3 | PE | Poval CP-1210T30 | 16 | 60.87% | 0 | 0.6 | 1.5 | 5 | Invention |
| 4 | Latex 1 | Poval CP7000 | 12 | 59.57% | 1.1 | 0.8 | 3.1 | 5 | Invention |
| 5 | Latex 2 | Poval CP1210T05 | 16 | 65.50% | 0.3 | 0.7 | 2.3 | 5 | Invention |

* Poval is tradename of Kuraray Co. Ltd (Osaka, Japan). Poval 7000 is an extrusion-grade polyethylene-co-vinylalcohol and Poval CP1210T05 is an extrusion-grade polyvinylalcohol. Mowiol is tradename of Clariant Chemical Company. Latex 1 and 2 are products of Rohm-Haas Chemical Company.

As can be seen in Table 1, the substrates with ink vehicle absorbing layers on the second side exhibited higher ink vehicle loss, reduced stacking haze, stacking color shift, and stacking bleed when compared to traditional polyethylene extruded substrates.

Example 2

In the second experiment, a first side of a paper substrate was extruded with traditional polyethylene and a second side of the paper substrate was extruded with the ink absorbing polymers of the present exemplary system and method. The coatweight and type of polymers used is described below in Table 2. A standard test image was printed on a photo-based porous inkjet recording medium with a HP Deskjet 6500 printer. Immediately after the image was ejected from the printer, the test substrates listed in Table 2 were placed on the surface of the test image so that the polymers coated on the second side of the substrate(s) were placed in contact with the test image. 20 sheets of plain paper were then placed on the top of the stacked image. After the test image was subject to stacking for 24 hours, stacking haze and color shift were then measured. Haze was measured by the change in L*min and colorshift was measured by Delta E. The results are shown in Table 2 below.

TABLE 2

| Exp. No. | Barrier Layer on First Side | Barrier Layer on Second Side | Coat-weight (GSM) | Haze Delta L | Average Gray shift DE | Remark |
|---|---|---|---|---|---|---|
| 6 | PE | PE | 40 | 4.08 | 5.46 | Control 1 |
| 7 | PE | PE | 40 | 3.97 | 5.56 | Control 2 |
| 8 | PE | Poval 4104MI | 30 | 2.17 | −1 | Invention |
| 9 | PE | EVAL M100 | 30 | 3.05 | 3.93 | Invention |
| 10 | PE | EVAL M100 | 20 | 2.79 | 3.53 | Invention |
| 11 | PE | EVAL M100/ Mowiflex TC-232 (80/20 ratio) | 22 | 2.27 | 1.25 | Invention |

* Poval 4104MI is an extrusion grade polyethylene-co-polyvinylalcohol by Kuraray Co. Ltd (Osaka, Japan). EVAL M100 is polyethylene-co-polyvinylalcohol (24% ethylene) by EVAL America. Mowiflex TC-232 is extrusion grade polyvinylalcohol by Clariant Chemical CO.

As can be seen in Table 2, the substrates with ink vehicle absorbing layers on the second side exhibited much reduced stacking haze, stacking color shift, when compared to traditional substrate extruded with polyethylene.

In conclusion, a number of benefits may be provided by the present exemplary system and method, according to one exemplary embodiment. More specifically, the disclosed inkjet recording medium composition having a porous inkjet ink receiving material coated on a first side of a photobase layer and an ink vehicle absorbing layer coated on a second side of the photobase layer prevents curling, bleed, and colorshifting when the ink recording mediums are stacked.

The preceding description has been presented only to illustrate and describe exemplary embodiments of the present system and method. It is not intended to be exhaustive or to limit the system and method to any precise form disclosed. Many modifications and variations are possible in light of the above teaching. It is intended that the scope of the system and method be defined by the following claims.

What is claimed is:

1. An inkjet recording medium comprising:

a photobase substrate;

an inorganic oxide dispensed on a first side of said substrate; and an ink vehicle absorbing layer formed on a second side of said photobase layer, wherein said ink vehicle absorbing layer comprises a copolymer of ethylene and vinylalcohol.

2. The inkjet recording medium of claim 1, wherein said layer of inorganic oxide comprises one of a silica or an alumina.

3. The inkjet recording medium of claim 2, wherein said layer comprising silica or alumina is coated at between approximately 20 and 50 GSM.

4. The inkjet recording medium of claim 1, wherein said ink vehicle absorbing layer comprises polymers having water solubility greater than 1% at 250° C.

5. The inkjet recording medium of claim 1, wherein said ink vehicle absorbing layer comprises polymers configured to absorb greater than 1.0% by weight water when soaked for 24 hours at approximately 25° C.

6. The inkjet recording medium of claim 1, wherein ink vehicle loss of a print in a stack configuration of said inkjet recording medium is greater than approximately 50% more than ink loss in a stack of a recording medium where the ink vehicle absorbing layer was replaced with a polyethylene layer.

7. The inkjet recording medium of claim 1, wherein a stacked configuration of said inkjet recording medium is configured to experience either a 1 point reduction in delta L or delta L versus an inkjet recording medium where the ink vehicle absorbing layer was replaced with a polyethylene layer.

8. The inkjet recording medium of claim 1, wherein said layer comprising ink vehicle absorbing layer is coated at between 5 and 50 GSM.

9. The inkjet recording medium of claim 1, wherein said ink vehicle absorbing layer comprises a polymer selected from the group consisting of a polyvinylalcohol, a derivatized polyvinylalcohol, a polyethylene-co-polyvinylalcohol, a polyvinylalcohol-co-poly(vinylamine), a polyvinylpyrolidone, a polyvinylpyrolidone-co-polyvinylalcohol, a hydroxyethylcellulose, a hydroxypropylcellulose, a 2-methyloxazoline, a 2-ethyloxazoline, a poly(hydroxyethylmethacrylate), a poly(hydroxyethylacrylate), a poly(acrylamide), a poly(methacrylamide), a poly(vinylamide), a water dispersible polyester, a water dispersible polyurethane, a polymer latex, PLO, PPO, PLO-PPO copolymer, Ethylene-Co-Acrylic Acid (LAA), and blends thereof.

10. The inkjet recording medium of claim 9, wherein a mole % of ethylene in said ink vehicle absorbing layer is from 5 to 50%; and wherein said copolymer has a molecular weight from 1000 to 10,000,000.

11. The inkjet recording medium of claim 9, wherein said polyvinylalcohol has molecular weight ranges from 1000 to 10,000,000 and % hydrolysis from 50 to 99%;

wherein a ratio of the copolymer of ethylene and vinylalcohol and polyvinylalcohol in the ink vehicle absorbing layer ranges from 100 to 0 to 10 to 90 by weight.

12. The inkjet recording medium of claim 9, wherein said ink vehicle absorbing layer further comprises bead particles having particle size ranges from 1 to 40 um;

wherein a ratio of the polymer to bead particles in the ink vehicle absorbing layer is from 100 to 0 to 10 to 90 by weight.

13. The inkjet recording medium of claim 12, wherein said bead particles are chosen from a group consisting of silica, alumina, clay, silicate, calcium carbonate, polymethylmethacrylate, polyamide, polystyrene, and blends thereof.

14. The inkjet recording medium of claim 8, wherein said ink vehicle absorbing layer further comprises thermal stabilizers or heat stabilizers.

15. The inkjet recording medium of claim 14, wherein said thermal stabilizers or heat stabilizers comprise an organic tin compound, a phenolic antioxidant, hindered amine stabilizers, and the blends thereof;

wherein said thermal stabilizer is present in said ink solvent absorbing polymers in a quantity of between 0.05 to 5%.

16. The inkjet recording medium of claim 9, wherein said ink vehicle absorbing layer is applied to said substrate layer by an extrusion coating method.

17. The inkjet recording medium of claim 16, wherein said layer of ink vehicle absorbing layer has a surface finish with a roughness of at least approximately 200 Sheffield units.

18. The inkjet recording medium of claim 1, wherein said substrate comprises a paper fiber substrate.

19. The inkjet recording medium of claim 1, wherein said substrate comprises one of a clear film or an opaque film.

20. The inkjet recording medium of claim 1, further comprising a barrier layer disposed between said substrate layer and said layer of inorganic oxide.

21. The inkjet recording medium of claim 20, wherein said barrier layer comprises one of an extruded polyethylene, polyvinylbutyral, or polypropylene.

22. The inkjet recording medium of claim 20, further comprising a barrier layer disposed between said photobase layer and said layer of ink vehicle absorbing layer.

23. The inkjet recording medium of claim 1, wherein said ink vehicle absorbing layer comprises fillers or plasticizers.

24. The inkjet recording medium of claim 1, wherein said ink vehicle absorbing layer has a coatweight between approximately 1 and 40 GSM.

25. A method for forming an inkjet recording medium comprising:

providing a photobase layer;

dispensing a layer of inorganic oxide on a first side of said photobase layer; and dispensing a layer of ink vehicle absorbing layer on a second side of said photobase layer, wherein said ink vehicle absorbing layer comprises a copolymer of ethylene and vinylalcohol.

26. The method of forming an inkjet recording medium of claim 25, wherein said layer of ink vehicle absorbing layer comprises a polymer selected from the group consisting of polyvinylalcohol, a derivatized polyvinylalcohol, a polyethylene-co-polyvinylalcohol, a polyvinylalcohol-co-poly(vinylamine), a polyvinylpyrolidone, a polyvinylpyrolidone-co-polyvinylalcohol, a hydroxyethylcellulose, a hydroxypropylcellulose, a 2-methylozazoline, a 2-ethylozazoline, a poly(hydroxyethylmethacrylate), a poly(hydroxyethylacrylate), a poly(acrylamide), a poly(methacrylamide), a poly(vinylamide), a water dispersible polyester, a water dispersible polyurethane, a polymer latex, PEO, PPO, PEO-PPO copolymer, Ethylene-Co-Acrylic Acid (EAA), and blends thereof.

27. The method of forming an inkjet recording medium of claim 25, wherein said ink vehicle absorbing layer comprises polymers having water solubility greater than 1% at 25° C.

28. The inkjet recording medium of claim 25, wherein said ink vehicle absorbing layer comprises polymers configured to absorb greater than 1.0% by weight water when soaked for 24 hours at approximately 25° C.

29. The inkjet recording medium of claim 25, wherein ink vehicle loss of a print in a stack configuration of said inkjet recording medium is greater than approximately 50% more than ink loss in a stack of a recording medium where the ink vehicle absorbing layer was replaced with a polyethylene layer.

30. The inkjet recording medium of claim 25, wherein a stacked configuration of said inkjet recording medium is configured to experience either a 1 point reduction in delta L or delta L versus an inkjet recording medium where the ink vehicle absorbing layer was replaced with a polyethylene layer.

31. The method of forming an inkjet recording medium of claim 25, wherein said dispensing a layer of ink vehicle absorbing layer on a second side of said photobase layer comprises coating said second side of said photobase layer with said ink vehicle absorbing layer.

32. The method of forming an inkjet recording medium of claim 28, wherein said ink vehicle absorbing layer is coated onto said second side of said photobase layer by one of a slot coater, a curtain coater, a cascade coater, or a blade coater.

33. The method of forming an inkjet recording medium of claim 25, further comprising depositing a barrier layer between said photobase layer and said layer of inorganic oxide.

34. The method of forming an inkjet recording medium of claim 30, wherein said depositing a barrier layer comprises coating said photobase layer with one of an extruded polyethylene, polyvinylbutyral, or polypropylene.

35. The method of forming an inkjet recording medium of claim 25, further comprising embossing a texture on said layer of ink vehicle absorbing layer.

* * * * *

UNITED STATES PATENT AND TRADEMARK OFFICE

CERTIFICATE OF CORRECTION

PATENT NO. : 7,641,947 B2
APPLICATION NO. : 11/441536
DATED : January 5, 2010
INVENTOR(S) : Tienteh Chen et al.

It is certified that error appears in the above-identified patent and that said Letters Patent is hereby corrected as shown below:

In column 11, line 54, in Claim 4, delete "250°" and insert -- 25° --, therefor.

In column 12, line 18, in Claim 7, delete "L" and insert -- E --, therefor.

In column 12, lines 28-29, in Claim 9, delete "polyvinylpyrolidone, a polyvinylpyrolidone-co-polyvinylalcohol," and insert -- polyvinylpyrrolidone, a polyvinylpyrrolidone-co-polyvinylalcohol, --, therefor.

In column 12, line 35, in Claim 9, delete "PLO," and insert -- PEO, --, therefor.

In column 12, line 35, in Claim 9, delete "PLO-PPO" and insert -- PEO-PPO --, therefor.

In column 12, line 36, in Claim 9, delete "(LAA)," and insert -- (EAA), --, therefor.

In column 12, line 59, in Claim 14, delete "claim 8," and insert -- claim 9, --, therefor.

In column 13, line 39, in Claim 26, delete "polyvinylpyrolidone," and insert -- polyvinylpyrrolidone, --, therefor.

In column 13, lines 39-40, in Claim 26, delete "polyvinylpyrolidone-co-polyvinylalcohol," and insert -- polyvinylpyrrolidone-co-polyvinylalcohol, --, therefor.

In column 13, lines 41-42, in Claim 26, delete "2-methylozazoline, a 2-ethylozazoline," and insert -- 2-methyloxazoline, a 2-ethyloxazoline, --, therefor.

In column 14, line 20, in Claim 30, delete "L" and insert -- E --, therefor.

Signed and Sealed this

Twenty-ninth Day of June, 2010

David J. Kappos

David J. Kappos
*Director of the United States Patent and Trademark Office*